US005081504A

United States Patent [19]

Morisawa et al.

[11] Patent Number: 5,081,504

[45] Date of Patent: Jan. 14, 1992

[54] DRUM CLEANING UNIT FOR IMAGE RECORDING APPARATUS

[75] Inventors: Satoru Morisawa, Kitamachi; Seiichi Mori, Fujisawa; Masato Matsubara, Tokyo, all of Japan

[73] Assignee: Asahi Kogaku Kogyo Kabushiki Kaisha, Tokyo, Japan

[21] Appl. No.: 457,842

[22] Filed: Dec. 27, 1989

[30] Foreign Application Priority Data

Dec. 28, 1988 [JP] Japan ..... 63-171047

[51] Int. Cl.[5] ..... G03G 21/00

[52] U.S. Cl. ..... 355/299; 355/219; 15/256.51

[58] Field of Search ..... 355/297, 298, 299; 118/652; 15/256.51

[56] References Cited

U.S. PATENT DOCUMENTS

| | | | |
|---|---|---|---|
| 3,940,282 | 2/1976 | Hwa | 355/299 Y |
| 4,111,545 | 9/1978 | Meltzer | 355/298 |
| 4,616,924 | 10/1986 | Kimura et al. | 355/297 |
| 4,931,840 | 6/1990 | Tanzawa et al. | 355/298 |
| 4,984,028 | 1/1991 | Tonomoto | 355/297 |

FOREIGN PATENT DOCUMENTS

| | | | |
|---|---|---|---|
| 57-204575 | 12/1982 | Japan | 355/299 |
| 59-188684 | 10/1984 | Japan | 355/299 |
| 61-122679 | 6/1986 | Japan | 355/299 |
| 63-58478 | 3/1988 | Japan | 355/299 |
| 63-304285 | 12/1988 | Japan | 355/299 |

*Primary Examiner*—Joan H. Pendegrass
*Attorney, Agent, or Firm*—Sandler, Greenblum & Bernstein

[57] ABSTRACT

A drum cleaning unit is positioned in an image recording apparatus utilizing an electrophotographic system in which a photoconductive drum is employed to form a toner image thereon. The unit comprises a plurality of blade members for removing residual toner from the surface of the photoconductive drum, and a support structure for independently, adjustably supporting respective blade members on the image recording apparatus.

17 Claims, 5 Drawing Sheets

DRUM CLEANING UNIT FOR IMAGE RECORDING APPARATUS

BACKGROUND OF THE INVENTION

1. Field of the Invention

The present invention generally relates to a drum cleaning unit for mechanically removing residual toner from a circumferential surface of a photoconductive drum after the transfer of a toner image in an image recording apparatus, and specifically to units used in such apparatus utilizing electrophotographic image transfer systems.

2. Discussion of Background Invention

Conventional image recording devices utilizing electrophotographic transfer systems are known in which the surface of a photoconductive drum is exposed to light to form a latent image on the drum surface, toner is then applied to the latent image to develop the image, and the developed image is transferred onto a recording sheet, where it is then fixed by a fixing unit. Such image recording devices are chiefly employed in copying machines. In recent years, however, such image recording devices have also been utilized in printers and like apparatus for printing the outputs of computers; one such apparatus is the laser beam printer.

The laser beam printer comprises, as in one example which is illustrated in FIG. 1, a photoconductive drum 1. Arranged about the photoconductive drum 1, in sequential order as viewed in the rotational direction of the drum, are a charging station A, an exposure station B, a developing station C, a transferring station D, a toner-cleaning station E, and a discharge station F.

The arrangement is such that at the exposure station B, a laser beam scans the surface of the drum 1, which has been uniformly charged at the charging station A, to thereby form a latent image on the charged drum surface. Toner is then applied at the developing station c to the latent image in order to develop the same. Subsequently, the developed toner image is transferred at the transferring station D onto the recording sheet P, which is traveling at a velocity which is identical to the peripheral speed of the photoconductive drum 1. The recording sheet P, carrying the toner image transferred onto the sheet at the transfer station D, is guided and/or fed by guide rollers to a fixing station G. The recording sheet P is then heated and/or pressed at the fixing station G so that the toner image will be fixed onto the surface of the recording sheet P.

Drum cleaning methods broadly fall into the following two types: the first is the "blade method", using a blade for scraping residual toner from the circumferential surface of the photoconductive drum by pressing the blade against the photoconductive drum under a given pressure; and the second is the "brush method", comprising the steps of charging a rotary brush formed of chargeable material, making it both rotate around and contact the circumferential surface of the photoconductive drum, having a residual toner on the drum electrostatically absorbed by the brush, and then letting toner mechanically fall from the brush.

The blade method is generally preferred to the brush method because the latter tends to make construction of the cleaning system complicated as well as costly.

The blade used in the blade method is generally made of an elastic polymeric compound, such as synthetic or natural rubber, and should be capable of completely removing residual toner without wearing and damaging the photoconductive surface of the drum.

If, however, such a blade is made of hard material, it will quickly wear and/or damage the photoconductive drum surface, because the drum surface is relatively poor in mechanical strength (i.e., particularly in its wear resistance). Such undue and undesirable wear often occurs because the blade is made of the aforementioned elastic material, in the form of a flat plate having a given thickness, such that the blade will continually touch the surface of the photoconductive drum.

As a result, the cleaning capability and efficiency of the blade method is generally dependent upon various conditions, including the hardness and shape (i.e., the length and thickness) of the blade, as well as the contact angle between the blade and the circumferential surface of the photoconductive drum.

There are generally two ways to contact the blade with the surface of the photoconductive drum; one is the so-called "trailing way", in which the blade is inclined towards the upstream side of the rotation of the photoconductive drum, with respect to a line which is perpendicular to a tangent line at the contact point; the second way is the so-called "counter way", in which the blade is inclined, contrary to the first way, towards the downstream side of the rotation of the photoconductive drum.

In any event, the resultant force of the reaction force generated when the blade is pressed against the photoconductive drum, and the frictional force generated as the photoconductive drum rotates, is applied to the blade. When the trailing way is used, the resultant force urges the blade to bend in a direction in which the blade is directed away from the photoconductive drum 1, whereby the contact pressure is weakened and the photoconductive drum is insufficiently cleaned. Accordingly, in such cases the blade must have a given hardness and thickness, for instance, a hardness H, as determined by the JIS (i.e., the Japanese Industrial Standard) Scale A, equal to 70, and a thickness $T=3$ mm. Further, such a blade should be pressed against the surface of the drum under relatively strong pressure, in order to insure adequate cleaning of the drum.

Moreover, since the blade has to be pressed against the whole corresponding longitudinal area on the circumferential surface of the photoconductive drum 1 under a uniform pressure, it becomes difficult to adjust/set the pressure to be exerted.

Although the contact pressure of the blade should preferably be as weak as possible (to reduce drum wear) within all possible ranges of pressure which result in a satisfactory cleaning of the drum, it tends to be set at relatively higher levels each time the pressure is adjusted, in order to sufficiently clean the circumferential surface of the photoconductive drum 1. This often results from the difficulty of appropriately setting the pressure. As a result, abrasion of the surface of the photoconductive drum is, accordingly, accelerated, so as to disadvantageously reduce the durability of the drum surface. Further, since the force or burden required to rotate the photoconductive drum increases, due to the relatively high pressure applied thereto by the blade, it becomes necessary to employ a high-power drive motor, which renders the imaging apparatus not only large-sized, but also expensive.

SUMMARY OF THE INVENTION

It is, therefore, an object of the present invention to provide a drum cleaning unit capable of sufficiently cleaning the circumferential surface of a photoconductive drum under relatively weak contact pressure between the drum and blade, while being also capable of easily adjusting or setting the contact pressure exerted by the blade.

In order to accomplish such objects, according to the present invention, a drum cleaning unit is provided to be used with an image recording apparatus utilizing an electrophotographic system, in which a photoconductive drum is employed to form a toner image thereon; the unit comprises a plurality of blade members for removing residual toner on the surface of the photoconductive drum, and support means for supporting respective blade members. The support structure permits each of the blades to be angularly adjusted with respect to the drum.

Thus, the objects of the invention are achieved by the structure described herein. Specifically, a plurality of blades have been provided to effect adequate cleaning, in a sequential fashion, of toner from a photoconductive drum; because a plurality of blades are provided, the force exerted on the drum is less than that exerted by a single blade, resulting in less wear on the drum surface. Further, each of the blades is easily adjustably positioned, such that the blades may be manually moved without effecting the ability of the blades to satisfactorily clean the drum.

To effect adequate cleaning, and to minimize wear on the drum surface, the blades are positioned, in a trailing fashion, in only the lower third quadrant of the drum, i.e., in the lower right hand drum quadrant; and/or the blades are angled differently with respect to the drum surface. In this fashion, toner will be effectively conducted to the bottom of an excess toner receiving chamber. The blades can also be attached to an upper wall of the toner receiving chamber. By so locating the "trailing" blades, and by being able to easily and individually adjust the blades, drum cleaning can be more efficiently effected than in the apparatus disclosed in, e.g., KATAYAMA et al., U.S. Pat. No. 3,859,691, in which a plurality of blades are used to clean a drum surface.

By angling the blades differently with respect to the drum surface, and specifically by angling the upstream blade at a smaller angle with respect to the drum surface than the downstream blade, more efficient cleaning of residual toner from the drum surface can be achieved.

In one aspect of the present invention, a drum cleaning unit is adapted to be positioned in an image recording apparatus of the electrophotographic type. The apparatus includes a photoconductive drum adapted to have a toner image formed thereon, and the unit comprises a plurality of blade members for removing residual toner from a circumferential surface of the photoconductive drum, a chamber for receiving the removed residual toner and means for independently and adjustably supporting respective blade members on said chamber.

In a second aspect of the present invention, a drum cleaning unit which is adapted to be positioned in an electrophotographic image recording apparatus having a rotatable photoconductive drum with a peripheral surface which is adapted to have a toner image formed thereon. The drum has first, second, third and fourth quadrants, with the third quadrant being the lower right-hand quadrant of said drum. The drum cleaning unit comprises first means for . removing an initial amount of residual toner from the surface of the drum, and second means for thereafter removing additional residual toner from the drum surface, the first and second removing means being positioned directly adjacent to the third quadrant.

In a third aspect of the present invention, a drum cleaning unit is adapted to be positioned in an electrophotographic image recording apparatus having a rotatable photoconductive drum with a peripheral surface which is adapted to have a toner image formed thereon. The drum cleaning unit comprises connected upper and lower walls, and first and second sidewalls, a first flexible blade for scraping toner from the drum surface, with the first blade being positioned within a first holder which is slidably positioned along the upper wall. The first holder comprises means for maintaining one end of the first blade in contact with the drum surface at a first angle with respect to the surface, at a first angular position about the drum. A second flexible blade is used for scraping toner from said drum surface after said first flexible blade has scraped toner from the drum surface, with the second blade being positioned within a second holder slidably positioned along said first sidewall. The second holder comprises means for maintaining one end of the second blade in contact with the drum surface at a second angle with respect to the surface, and at a second angular position about the drum which is spaced from the first angular position, and means are provided for holding toner scraped from the drum by said first and second blades.

In another aspect of the present invention, a drum cleaning unit is adapted to be positioned in an image recording apparatus of the electrophotographic type, with the apparatus including a photoconductive drum adapted to have a toner image formed thereon. The unit comprises a plurality of blade members for removing residual toner from a circumferential surface of the photoconductive drum, with each of the blade members having a free end and being adapted to contact a surface of the drum, and means for supporting respective blade members at different angles with respect to the drum surface.

BRIEF DESCRIPTION OF THE DRAWINGS

The above and other objects, features and advantages of the present invention are illustrated in the accompanying drawings, in which like reference numerals represent similar parts throughout the several views, and wherein.

DETAILED DESCRIPTION OF THE DRAWINGS

Figure 1:
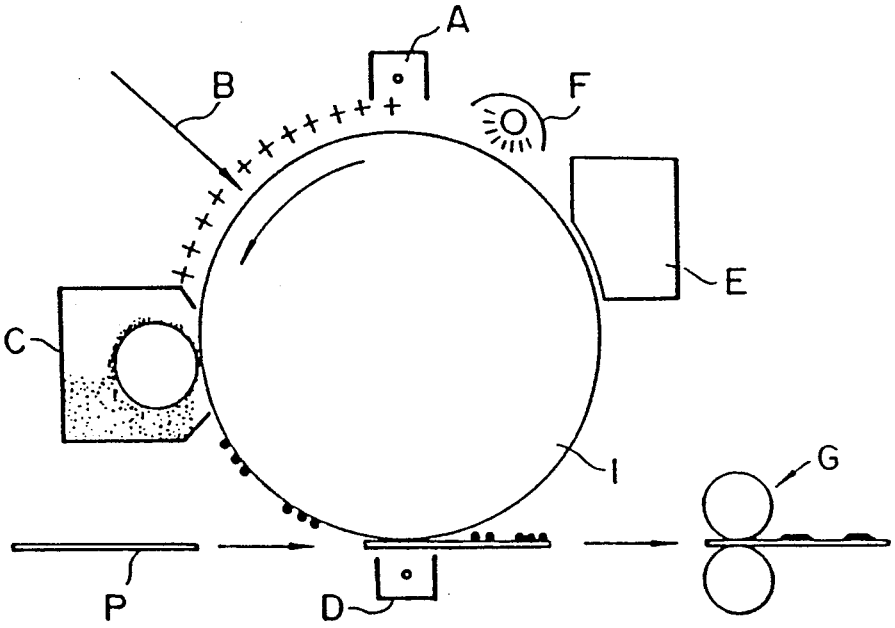
FIG. 1 PRIOR ART
FIG. 1 is a schematic sectional view illustrating a conventional imaging apparatus utilizing an electrophotographic system.
Figure 2:
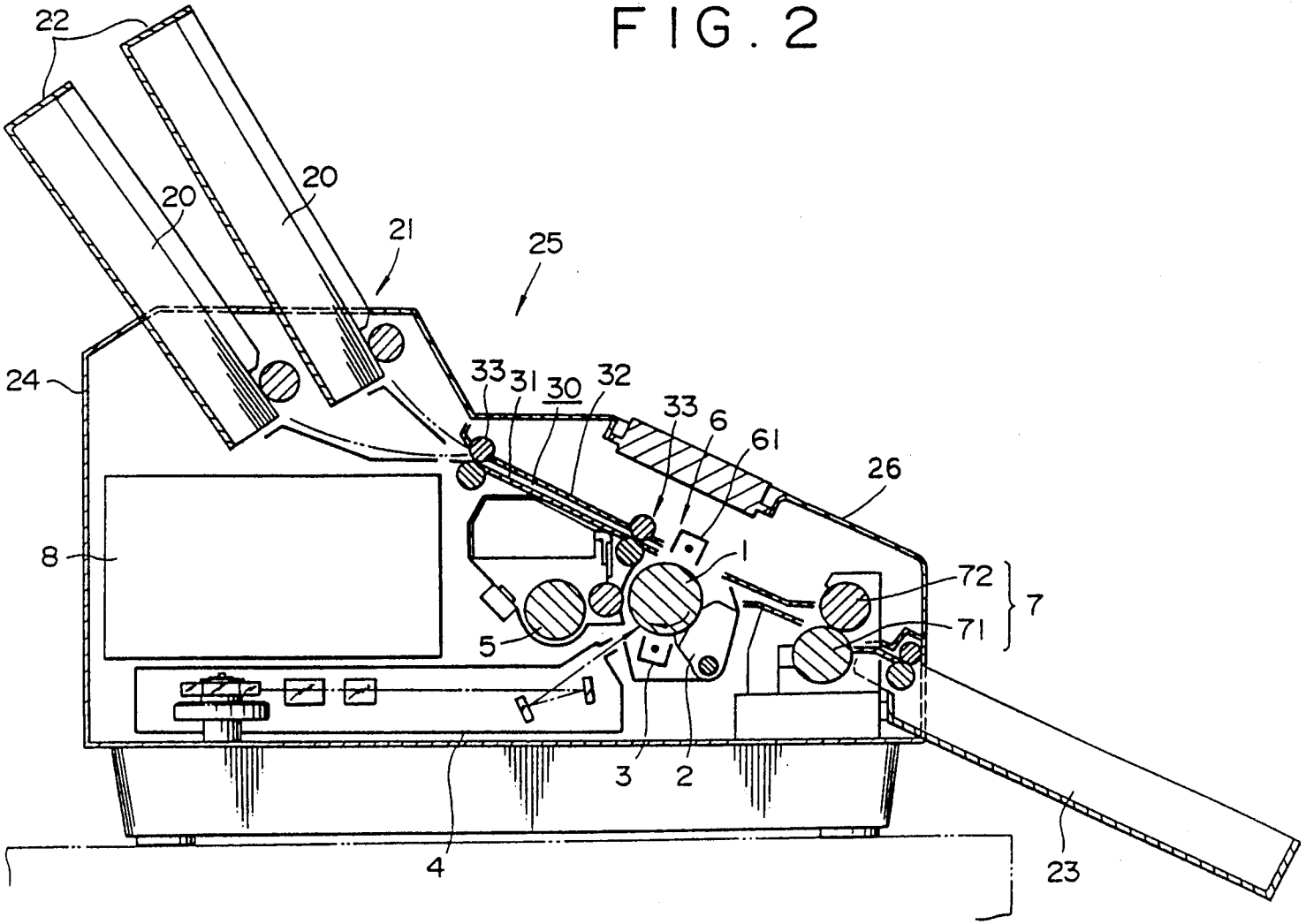
FIG. 2 is a schematic sectional view illustrating a laser beam printer employing a drum cleaning unit in accordance with the present invention.

With more specific reference to the drawings, FIG. 2 is a schematic side sectional view illustrating a laser beam printer, representative of one type of electrophotographic printer utilizing a drum cleaning unit embodied in the present invention.

The laser beam printer 25 shown in FIG. 2 generally approximates the shape of a rectangularly-shaped box, with its top diagonally cut at a predetermined angle; and the printer consists of a body 24 and a clamshell type cover 26 hinged to the body.

The uppermost section of the body 24 forms a cassette holding portion 21 adapted to receive a pair of paper cassettes 22, 22 into which differently sized paper can be respectively stored. When a printing operation is being executed, recording paper is individually and sequentially introduced into a paper feed path 30. An exiting paper tray 23 is provided at one side of the body 24, generally along an opposite end of a diagonal extending from the cassette holding portion 21.

The paper tray 23 is capable of rocking or pivoting in a generally vertical direction at a predetermined angle, and is also capable of remaining still at any given angle.

Upper cover plate 31 of body 24, and lower cover plate 32 of the clamshell 26, define between them the paper feed path 30. The paper feed path 30 has a substantially uniform thickness, and is directed downwardly at substantially the same inclination angle as is the upper inclined surface of the clamshell 26.

A pair of opposed feed rollers 33, 33 are each provided on respective cover plates 32, 31, one of which is driven to rotate by a drive means (not shown).

A photoconductive drum 1 is disposed under a substantially central area of the paper feed path 30 in the body 24.

A plurality of processing units are sequentially disposed around the photoconductive drum 1 in the body 24, in the direction (i.e., clockwise as shown) of drum rotation, and in the order described hereinafter: a cleaning unit 2 for removing toner remaining on the surface of the drum 1, a charging unit 3 for uniformly charging the surface of the drum 1, a laser scanning unit 4 for scanning the charged surface of the drum with laser beams carrying image data in order to form a latent image thereon, and a developing unit 5 for placing toner onto the portion of the surface of the drum 1 exposed to the laser beams so as to develop a toner image. A control unit 8 is provided for controlling the operation of the printer 25, with the unit including a power source (not illustrated).

Further, a corona charger 61 for charging the recording paper 20, so that the toner image on drum 1 will be transferred to the paper, is disposed in the clamshell 26, oppositely from the drum 1, with the paper feed path 30 therebetween. The corona charger 61, and the portion of the drum 1 positioned oppositely of the charger, together constitute a transfer unit 6.

A fixing unit 7 is arranged downstream of the transfer unit 6 along the paper feed path 30. The fixing unit 7 comprises a heater roll 71 and a backup roll 72 oppositely disposed with respect to each other, which together define a portion of the paper feed path 30 therebetween. Recording paper 20, carrying the unfixed toner image thereon, is nipped between rolls 71 and 72, and toner is fixed onto the recording paper 20 by heat and pressure applied by the heater roll 71. A drive motor, not shown, is employed to rotate the heated roll 71 to move the recording paper 20 while within the fixing unit 7.

A laser beam printer thus constructed operates in the following fashion.

Recording paper 20, stored in any one of the paper cassettes 22, 22 fitted within cassette holding portion 21 of body 24, is individually drawn out of the cassettes into the paper feed path 30. Recording paper 20, thus introduced into the paper feed path 30, is fed by the feed rollers 33, 33. The toner image formed on the surface of the photoconductive drum 1 is transferred to the undersurface of recording paper 20 at the transfer unit 6. The toner image transferred onto the undersurface of the recording paper 20 is fixed by the fixing unit 7, and recording paper 20 is then moved outwardly, onto the exit paper tray 23, with its image-carrying side down (i.e., positioned in a face down state).

Figure 3:
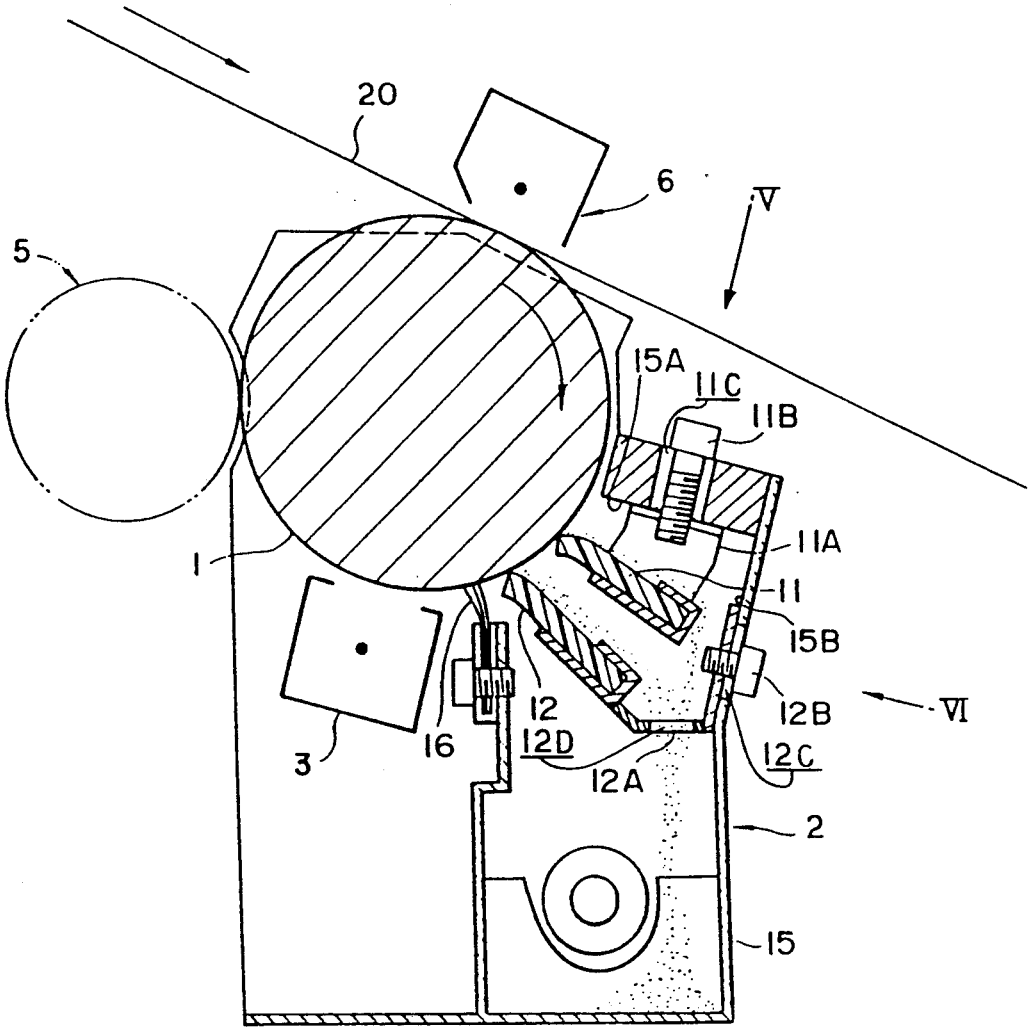
FIG. 3 is a sectional view of a drum cleaning unit formed in accordance with a first embodiment of the present invention.

FIG. 3 is a sectional view o the drum cleaning unit employed in the above laser beam printer.

The cleaning unit 2 comprises a first blade 11 and a second blade 12, which are disposed, as viewed from along the rotational direction of the photoconductive drum 1, in a box-like casing 15, and a discharging brush 16, which is grounded, for electrically discharging the surface of the photoconductive drum 1.

The casing 15 is in the form of a box or chamber which is generally vertically oblong, and substantially rectangular, and which is substantially equal in longitudinal length (i.e., in width) to the axial length of the photoconductive drum 1. The upper section of the case 15 is open to the circumferential surface of the photoconductive drum 1, and the first and second blades 11, 12 are disposed in the upper section of the case 15 in such a manner that they are adapted to come into contact with the circumferential surface of the photoconductive drum 1.

The first blade 11 is supported by a holder 11A which is adjustably secured to the upper inner wall 15A of casing 15 by means of screws 11B (only one screw is illustrated in the drawings), and is positioned to contact the surface of the photoconductive drum 1 at a given angle. The thickness of the first blade 11 is less than that of a conventional blade, in apparatus in which a single blade has been used. In this embodiment, the surface of the photoconductive drum is sufficiently cleaned with a blade having a thickness of approximately 2 mm and a hardness of 63–77 (as measured on the JIS Scale A referred to above).

Figure 5:
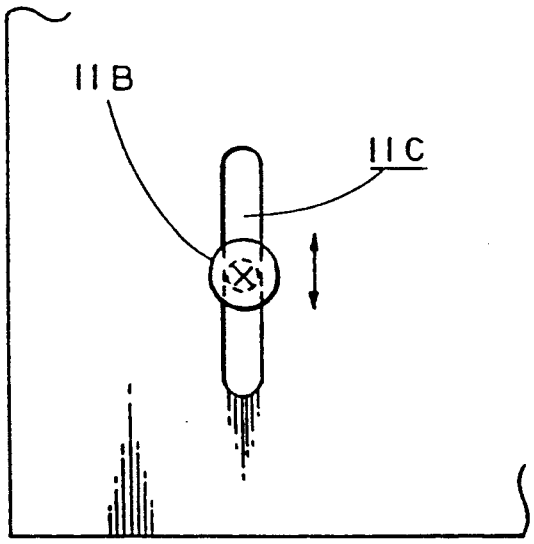
FIG. 5 is an enlarged partial view of the drum cleaning unit of the present invention, as viewed from the direction of arrow V in FIG. 3.

Openings 11C are formed in the upper wall of casing 15, as shown in FIG. 5 (although only such one opening 11C is illustrated) in such a manner that respective screws 11B can slide along corresponding openings 11C when the screws 11B are loosened. The contact pressure of the first blade 11 with respect to the circumferential surface of the photoconductive drum 1 can be adjusted by moving the screws 11B relative to the openings 11C in the directions represented by the arrows in FIG. 5, which can be effected once the screws 11B are loosened.

It should be noted that the smaller is the angle of the sliding direction of the holder 11A with respect to a tangent line "$T_1$-$T_1$", at a contact point "$P_1$" between the front end of the blade 11 and the circumferential surface of the photoconductive drum 1, the greater is the amount of sliding which is required to increase or decrease a given amount of contact pressure of the blade 11 against the circumferential surface of the photoconductive drum 1.

The second blade 12 is supported by a plurality of holders 12A secured by screws 12B (again, only one such screw is illustrated in the drawings with its respective holder) to the inner side wall 15B of the case 15. The second blade 12 is spaced apart from the first blade 11, about the drum periphery, by a given interval, and is forced to contact the surface of the photoconductive drum 1 at a given angle. Although the second blade 12 has the same thickness and hardness as the first blade 11 in this embodiment, they may be different from each other.

The upper portion of the inner side wall 15B of the case 15 is slightly inclined in a direction such that the bottom of this portion of wall 15B diverges away from the photoconductive drum 1.

It should be noted that the smaller is the angle of the sliding direction of the holder 12A with respect to the tangent line "$T_2$-$T_2$" at a contact point "$P_2$" between the front end of the blade 12 and the circumferential surface of the photoconductive drum 1, the greater is the amount of sliding which will be necessary to increase or decrease a given amount of contact pressure of the blade 12 against the circumferential surface of the photoconductive drum 1.

Figure 6:
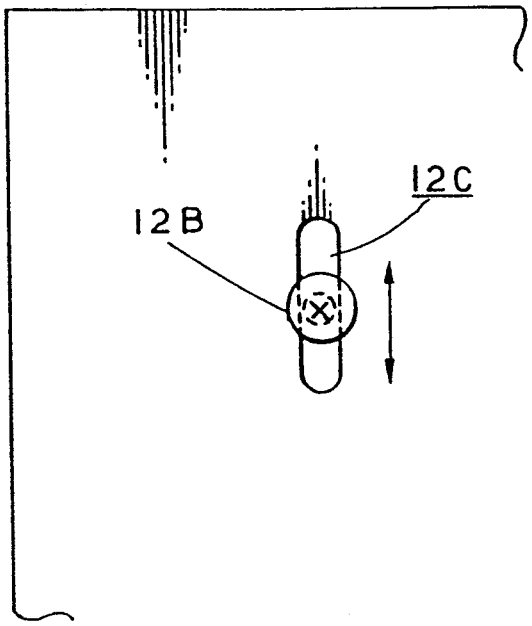
FIG. 6 is an enlarged partial view of the drum cleaning unit, viewed from the direction of arrow VI in FIG. 3.

Openings or slots 12C are formed in the case 15 as shown in FIG. 6 (again, only one representative opening 12C is illustrated) in such a manner that the screws 12B can slide along the openings or slots 12C when the screws 12B are loosened. The contact pressure of the second blade 12 with the circumferential surface of the photoconductive drum 1 can therefore be adjusted by moving the screws 12B relative to the openings 12C in the direction represented by the arrow in FIG. 6, whenever the screws 12B are loosened.

Therefore, both the angle of inclination and the longitudinal position of the respective blade determine the contact pressure against the circumferential surface of the photoconductive drum.

Openings 12D are formed in the respective holders 12A, and toner which is scraped by both the first and second blades is allowed to fall down through the openings 12D, outwardly from the bottom of holder 12, into the bottom of casing or chamber 15.

Figure 4:
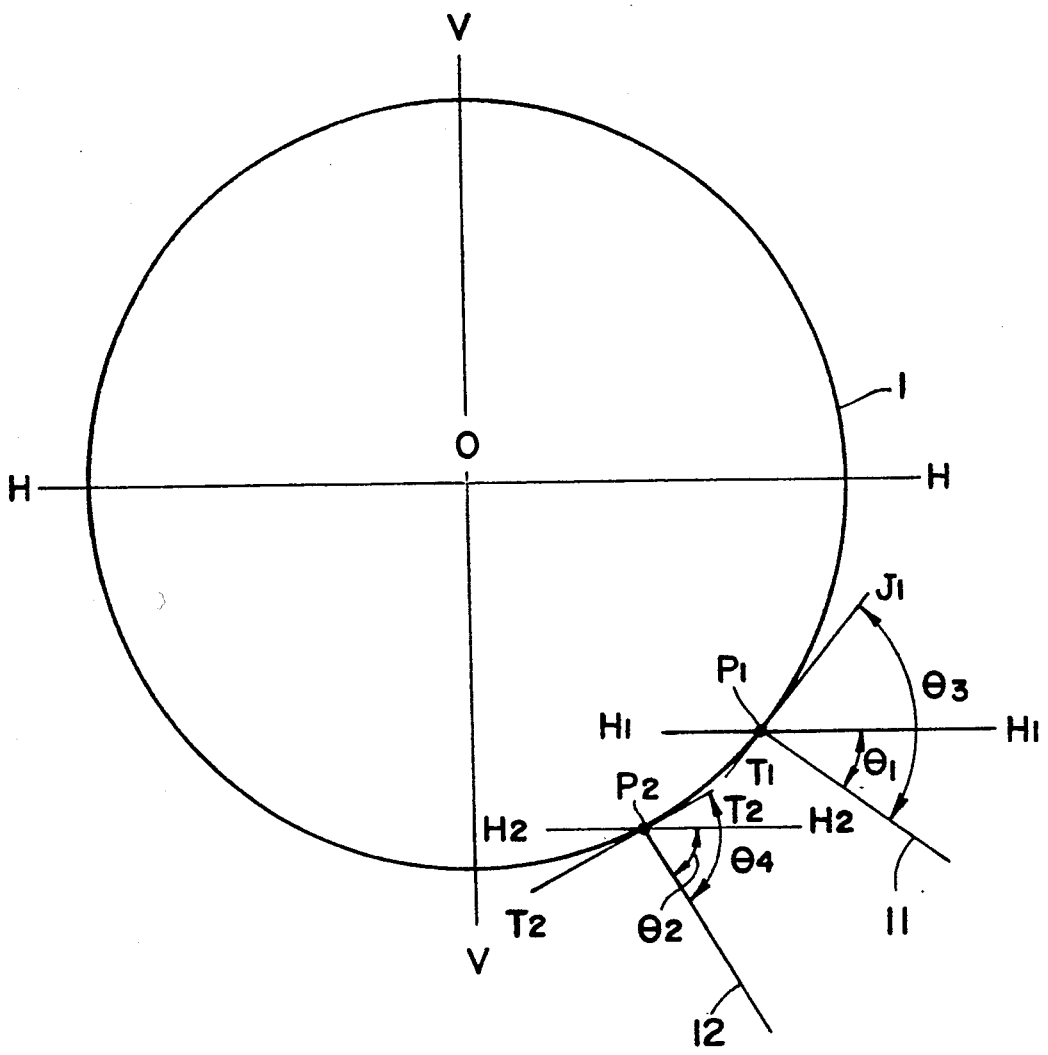
FIG. 4 is a conceptual schematic drawing illustrating representative set angles of two blade members.

The first and second blades 11, 12 are both disposed, as shown in FIG. 4, in the third quadrant (i.e., lower right hand quadrant) of the drum, in an area below a horizontal line H-H extending through the rotary center "0" of the photoconductive drum 1, and upstream, in the direction of rotation of the photoconductive drum 1, of a vertical line V -V extending through the rotary center "0" of the photoconductive drum 1. Each of the blades 11, 12 is inclined in the direction of rotation of the photoconductive drum 1, with respect to horizontal lines "$H_1$-$H_1$" and $H_2$-$H_2$", which extend through the respective contact points "$P_1$" and "$P_2$" between the front end of the blade member 11, 12, respectively, and the circumferential surface of the photoconductive drum 1. The blades are each inclined at an angle which is between zero degrees and the angle of a line perpendicular to the respective tangent lines "$T_1$-$T_1$", "$T_2$-$T_2$" at the respective contact points "$P_1$", and "$P_2$". Their angles of inclination, as set, are determined such that the upper surfaces of the blades 11, 12 are inclined at angles of "$\theta_1$","$\theta_2$" with the horizontal lines "$H_1$-$H_1$", "$H_2$-$H_2$" at the contact points "$P_1$", "$P_2$", respectively.

With this arrangement, the toner scraped off by blade 11 or 12 can easily slip down along the upper surface of blade 11 or 12 toward toner chamber 15 so that the scraped toner remaining at the contact area between the drum surface and the blade, which causes insufficient cleaning is prevented.

Further, the angle "$\theta_2$" is set to be greater than the angle "$\theta_1$" so that the spacing between blades 11 and 12 becomes larger in the direction from the drum surface to toner chamber 15. With this arrangement, the toner scraped by and slipped along blade 12 being collected between the blade 11 and 12, which also causes insufficient cleaning is prevented.

Moreover, the angles of inclination, as set, are additionally determined such that the upper surfaces of the blades 11, 12 are inclined at angles of "$\theta_3$", "$\theta_4$" with the tangent lines "$T_1$-$T_1$", "$T_2$-$T_2$" at the contact points "$P_1$", "$P_2$", respectively, and the angle "$\theta_4$" is set to be greater than the angle "$\theta_3$". With this arrangement, the toner which has not been scraped off by first blade 11 can be effectively scraped off by second blade 12. That is, in such a trailing system, the larger the inclination angle (i.e., "$\theta_3$" or "$\theta_4$") of the blade with respect to the cleaning surface is, the higher the cleaning effect becomes. Accordingly, even though first blade 11 fails to completely scrape the residual toner from the drum surface, second blade 12 can effectively scrape the remaining toner.

In a cleaning unit 2 designed for cleaning with a pair of blades, residual toner that has not been transferred to the recording paper 20 in the transfer unit 6, and which remains on the surface of the photoconductive drum 1, is first scraped by the first blade and then by the second blade. In this way, the photoconductive drum 1 can readily be cleaned by the second blade even though toner is not entirely scraped off by the first blade. Toner which is thus scraped off is caused to fall down along the upper surfaces of the blades 11, 12, and is stored in the bottom of the case 15.

Since the second blade 12 is for scraping the residual toner left after a substantial part of the residual toner has been scraped from the drum by the first blade 11, the set angles for the blades may be set such that: $\theta_2 > \theta_1$ As discussed above, the use of only a single blade in a "trailing" drum cleaning system requires that a relatively large force be applied to the blade member, requiring greater torque to rotate the drum at a given speed. The present invention, by using two blades, makes it possible to reduce the force which must be applied to the blades. Accordingly, an additional blade (e.g., blade 11) is positioned upstream of a principal blade (e.g., blade 12) to preliminarily/initially scrape residual toner off of the drum surface, before such surface reaches the second blade. Accordingly, because blade 12 need not scrape all of the residual toner from the drum by itself, the force applied to the principal blade can be decreased, again reducing the torque required to rotate the drum.

When two such blade members are utilized, it is preferable that the angle $\theta_1$, at which upstream blade 11 is angled with respect to the drum, be smaller than the angle $\theta_2$, at which downstream blade 12 is so angled. Because the downstream blade must scrape any residual toner not scraped by the upstream blade, its angle must be larger, in order to provide for such efficient scraping.

Furthermore, regardless of the angle $\theta_1$, if angle $\theta_2$ is too small, toner scraped from the drum by blade member 12 may not drop to the bottom of the toner-catching chamber, and may undesirably stay between the two blade members. Such an undesirable tendency would more likely occur when $\theta_1$ is greater than $\theta_2$, since the spacing between the blades would decrease in a direction extending towards the toner chamber.

The pressure applied to the blades 11, 12 is thereby easily set, basically as follows:

The contact pressure of the first blade 11 is set in a manner similar to a conventional case, in which only one blade is employed. Since the second blade 12 is provided in the following stage, however, any residual toner which may be left uncleaned to some extent by the first blade 11 will be cleaned; and the contact pressure required to be exerted by the first blade may accordingly be relatively low, such that adjustment of the contact pressure balance exerted by the first blade may be effected by hand.

The second blade 12 is only for scraping the residual toner left by the first blade; therefore, the contact pressure required to be exerted by this blade can also be low, and the adjustment of the contact pressure balance can also be made by hand, as in the case of the first blade 11. Even though the contact pressures of the two blades 11, 12 exerted on the circumferential surface of the photoconductive drum 1 are set at random, it is quite unlikely that any toner will be left unscraped at the same spot by both blades; in other words, manual setting of the contact pressures can still provide good cleaning, while using the two blades.

As a result, contact pressure adjustment is easy, despite the provision of two blades. Since the contact pressure between blades and drum is also minimized, wearing of the surface of the photoconductive drum 1 caused by contact with the blades is decreased, with the resultant effect of not only improving the durability of the photoconductive drum 1, but also of decreasing the frictional resistance of the blades (because the frictional resistance of the blades varies depending upon the contact pressure level, irrespective of the drum area contacted). The load on the rotation of the photoconductive drum 1 is thus reduced; and, therefore, the motor needed for driving the photoconductive drum 1 to rotate can be made less powerful and more compact.

The drum cleaning unit is thus arranged, according to the present invention, so that toner left unscraped by the first blade at a preceding stage is removed by a second blade at a following stage, whereby low contact pressure is sufficient to implement cleaning. Further, the use of two blades which can be manually moved permits independent adjustment and/or setting of the contact pressure to be effected with ease.

As a result, wearing of the surface of the photoconductive drum by the blades is reduced, with the resultant effect of improving the durability of the photoconductive drum. Because drag on the drum is reduced by the pressure reduction, the drive motor needed to drive the photoconductive drum to rotate can also be made smaller and more compact than has previously been the case. A small-sized, durable imaging apparatus can thus be achieved.

While the present specification describes specific details and features of the present invention, it is clear that it equally applies to all embodiments which are within the scope of the claims appended hereto.

What is claimed is:

1. A drum cleaning unit which is adapted to be positioned in an electrophotographic image recording apparatus having a rotatable photoconductive drum with a peripheral surface which is adapted to have a toner image formed thereon, said drum having first, second, third and forth quadrants, said third quadrant being the lower right-hand quadrant of said drum, said drum surface, said first and second residual toner removing means being positioned directly adjacent to said third quadrant;

each of said first and second removing means being adapted to exert pressure on said drum surface, said unit thereby further comprising means for adjusting the pressure exerted by said first and second residual toner removing means, each of said first and second residual toner removing means comprising a blade having a first end adapted to contact said drum surface, each blade having a second end positioned within a movable holder, wherein at least one of said movable holders is spaced from a bottom surface of said cleaning unit, said at least one holder comprising an opening for conducting residual toner from said drum to the bottom surface.

2. A drum cleaning unit which is adapted to be positioned in an electrophotographic image recording apparatus having a rotatable photoconductive drum with a peripheral surface which is adapted to have a toner image formed thereon, said drum cleaning unit comprising:

(a) connected upper and lower walls, and first and second sidewalls;

(b) a first flexible blade for scraping toner from said drum surface, said first blade being positioned within a first holder slidably positioned along said upper wall, said first holder comprising means for maintaining one end of said first blade in contact with said drum surface at a first angle with respect to said surface, at a first angular position about said drum;

(c) a second flexible blade for scraping toner from said drum surface after said first flexible blade has scraped toner from said drum surface, said second blade being positioned within a second holder slidably positioned along said first sidewall, said second holder comprising means for maintaining one end of said second blade in contact with said drum surface at a second angle with respect to said surface, and at a second angular position about said drum which is spaced from said first angular position; and (d) means for holding toner scraped from said drum by said first and second blades.

3. A drum cleaning unit in accordance with claim 2, further comprising a grounded brush adapted to contact said drum surface, said grounded brush being held by said second sidewall at a third angular position about said drum which is spaced from said first and second angular positions.

4. A drum cleaning unit in accordance with claim 2, further comprising means for adjusting pressure exerted by respective blades on said drum surface by adjusting positions of said blades with respect to said drum.

5. A drum cleaning unit adapted to be positioned in an image recording apparatus of the electrophotographic type, said apparatus including a photoconductive drum adapted to have a toner image formed thereon, said unit comprising:

a plurality of blade members for removing residual toner from a circumferential surface of said photoconductive drum, each of said blade members having a free end adapted to contact a surface of said drum; and means for supporting respective blade members at different angles with respect to said drum surface, wherein said plurality of blade members comprise first and second blades, said first blade being inclined at an angle, with respect to said drum, which is smaller than the angle at which said second blade is so inclined, wherein said first blade is retained by a holder slidably positioned by a screw within a slot located along an upper wall of said cleaning unit, and said second blade is retained by a holder slidably positioned by a screw within a slot located along a side wall of said cleaning unit.

6. A drum cleaning unit for an electrophotographic image recording apparatus, wherein a photoconductive drum, rotatable in a predetermined direction, is employed to form a toner image thereon, the image being transferred onto a recording sheet, said drum cleaning unit comprising:

a plurality of blade members, concurrently contacting a surface of said photoconductive drum, for removing residual toner from the drum surface after the image transfer, said blade members being positioned below the horizontal center plane of said drum at the downwardly moving drum side, the upper surface of each of said blade members extending at an angle with respect to a corresponding line tangent to said drum surface, wherein said angle is between a position parallel to a horizontal plane and a position perpendicular to said tangent line, and wherein said corresponding tangent line touches said drum surface at a point where a line projecting from said upper surface intersects said drum surface.

7. The drum cleaning unit according to claim 6, wherein the angle of a lower one of said plurality of blade members is greater than the angle of an upper one of said plurality of blade members.

8. The drum cleaning unit according to claim 6, which further comprises a case having an upper section opened to the circumferential surface of said drum and containing said blade members therein, a lower section of said case collecting toner particles removed from said drum surface, both said upper and lower sections being connected via openings.

9. The drum cleaning unit according to claim 8, wherein said upper and lower sections are separated from each other by holding elements for a lower one of said blade members, said openings being provided in said holding elements.

10. The drum cleaning unit according to claim 8, wherein said blade members are adjustably mounted in said case

11. The drum cleaning unit according to claim 10, wherein an upper one of said blade members is adjustable in a direction substantially radial with respect to said drum surface.

12. The drum cleaning unit according to claim 10, wherein a lower one of said blade members is adjustable in a direction substantially upwardly with respect to said drum surface.

13. The drum cleaning unit according to claim 6, wherein at least one of said blade members is composed of an elastic polymeric compound.

14. The drum cleaning unit according to claim 6, each of said blades being positioned within a blade holder attached to one or more screws, each of said one or more screws being slidably positioned within a slot located on a wall of said drum cleaning unit.

15. The drum cleaning unit according to claim 6, further comprising an electrically grounded discharge brush attached to a substantially vertical wall of said unit, said discharge brush having at least one end adapted to contact said drum surface.

16. The drum cleaning unit according to claim 6, each of said blade members having a flexible free end which extends in a direction allowing it to trail rotation of said drum.

17. The drum cleaning unit according to claim 6, further comprising means for adjusting the pressure exerted by said blade members on said drum surface by adjusting the positions of said blade members with respect to said drum.

* * * * *